US006695050B2

(12) United States Patent
Winslow et al.

(10) Patent No.: US 6,695,050 B2
(45) Date of Patent: Feb. 24, 2004

(54) EXPANDABLE RETAINING SHOE

(75) Inventors: Donald W. Winslow, Duncan, OK (US); Donald R. Smith, Duncan, OK (US); Lloyd A. Crockford, Houston, TX (US)

(73) Assignee: Halliburton Energy Services, Inc., Duncan, OK (US)

( * ) Notice: Subject to any disclaimer, the term of this patent is extended or adjusted under 35 U.S.C. 154(b) by 0 days.

(21) Appl. No.: 10/166,020

(22) Filed: Jun. 10, 2002

(65) Prior Publication Data

US 2003/0226660 A1 Dec. 11, 2003

(51) Int. Cl.[7] ..... E21B 23/00
(52) U.S. Cl. ..... 166/118
(58) Field of Search ..... 166/118, 134, 166/180, 196, 387

(56) References Cited

U.S. PATENT DOCUMENTS

| | | | | | |
|---|---|---|---|---|---|
| 2,368,928 | A | | 2/1945 | King | 166/10 |
| 4,151,875 | A | * | 5/1979 | Sullaway | 166/134 |
| 4,185,689 | A | * | 1/1980 | Harris | 166/133 |
| 4,457,369 | A | * | 7/1984 | Henderson | 166/134 |
| 4,765,404 | A | * | 8/1988 | Bailey et al. | 166/134 |
| 5,224,540 | A | | 7/1993 | Streich et al. | 166/118 |
| 5,271,468 | A | | 12/1993 | Streich et al. | 166/387 |
| 5,390,737 | A | * | 2/1995 | Jacobi et al. | 166/387 |
| 5,540,279 | A | * | 7/1996 | Branch et al. | 166/118 |
| 5,701,959 | A | * | 12/1997 | Hushbeck et al. | 166/387 |
| 5,857,520 | A | * | 1/1999 | Mullen et al. | 166/196 |
| 6,102,117 | A | | 8/2000 | Swor et al. | 166/138 |
| 6,167,963 | B1 | | 1/2001 | McMahan et al. | 166/179 |
| 2002/0043368 | A1 | * | 4/2002 | Bell et al. | 166/118 |

FOREIGN PATENT DOCUMENTS

EP 1 197 632 A2 4/2002 ..... E21B/33/12

OTHER PUBLICATIONS

Halliburton Services Sales & Service Catalog No. 43, pp. 2561–2562 and 2556–2557 (1985).

* cited by examiner

*Primary Examiner*—David Bagnell
*Assistant Examiner*—Brian Halford
(74) *Attorney, Agent, or Firm*—John W. Wusterberg; Anthony L. Rahhal

(57) ABSTRACT

An improved downhole tool apparatus for limiting the extrusion of a packer element. The apparatus includes a packer mandrel having a packer element assembly disposed in a wellbore. Packer retaining shoes are disposed about the packer mandrel at the ends of the packer element assembly. The packer retaining shoes have an inner retainer and an outer retainer. The inner retainer has a plurality of segments having gaps therebetween that expand in width when the retaining shoe is moved from an initial position in which it is disposed about the packer mandrel to an expanded position wherein it engages the wellbore to limit the extrusion of the packer element assembly. The outer retainer is likewise made up of a plurality of segments having gaps therebetween that will expand. The outer retainer engages the wellbore to limit the extrusion of the packer element assembly. The inner retainer segments cover the gaps that exist between the outer retainer segments and the outer retainer segments cover the gaps that exist between the inner retainer segments so that extrusion is limited. The packer retaining shoes also include a wedge disposed about the packer mandrel at the upper and lower ends of the packer element assembly. The retaining shoes provide enhanced high temperature and higher pressure performance in that extrusion in wells having high temperature and high pressure is severely limited if not completely prevented.

28 Claims, 6 Drawing Sheets

32
30
34
15
46
44
50
48
10,11
50
52
20
54
66,68
60
22
24
26
56,57
38
42
66,70
36
74
28
72
76
79
78
40

EXPANDABLE RETAINING SHOE

FIELD OF THE INVENTION

This invention relates generally to downhole tools for use in wellbores and methods of drilling such apparatus out of wellbores, and more specifically, to such tools having drillable components made at least partially of composite or non-metallic materials, such as engineering grade plastics, composites, and resins. This invention relates particularly to improvements in preventing undesired extrusion of packer seal elements between segmented non-metallic packer element shoes, alternatively referred to as back-up shoes, back-up rings, retaining shoes, packer shoes, or retaining rings, used to provide support to expandable packer elements used in drillable, essentially nonmetallic packer and bridge plug type tools. This invention is especially suitable for use with such segmented non-metallic packer element retaining shoes used in extreme temperature and differential pressure environments which tend to make expandable packer element seals more prone to extrusion, related damage, and possibly failure.

BACKGROUND OF THE INVENTION

In the drilling or reworking of oil wells, a great variety of downhole tools are used. For example, but not by way of limitation, it is often desirable to seal tubing or other pipe in the casing of the well, such as when it is desired to pump cement or other slurry down the tubing and force the cement or slurry around the annulus of the tubing or out into a formation. It then becomes necessary to seal the tubing with respect to the well casing and to prevent the fluid pressure of the slurry from lifting the tubing out of the well or for otherwise isolating specific zones in a well. Downhole tools referred to as packers and bridge plugs are designed for these general purposes and are well known in the art of producing oil and gas.

When it is desired to remove many of these downhole tools from a wellbore, it is frequently simpler and less expensive to mill or drill them out rather than to implement a complex retrieving operation. In milling, a milling cutter is used to grind the packer or plug, for example, or at least the outer components thereof, out of the wellbore. Milling is a relatively slow process, but milling with conventional tubular strings can be used to remove packers or bridge plugs having relative hard components such as erosion-resistant hard steel. One such packer is disclosed in U.S. Pat. No. 4,151,875 to Sullaway, assigned to the assignee of the present invention and sold under the trademark EZ Disposal® packer.

In drilling, a drill bit is used to cut and grind up the components of the downhole tool to remove it from the wellbore. This is a much faster operation than milling, but requires the tool to be made out of materials which can be accommodated by the drill bit. Typically, soft and medium hardness cast iron are used on the pressure bearing components, along with some brass and aluminum items. Packers of this type include the Halliburton EZ Drill® and EZ Drill® SV squeeze packers.

The EZ Drill® SV squeeze packer, for example, includes a lock ring housing, upper slip wedge, lower slip wedge, and lower slip support made of soft cast iron. These components are mounted on a mandrel made of medium hardness cast iron. The EZ Drill® bridge plug is also similar, except that it does not provide for fluid flow therethrough.

All of the above-mentioned packers are disclosed in Halliburton Services—Sales and Service Catalog No. 43, pages 2561–2562, and the bridge plug is disclosed in the same catalog on pages 2556–2557.

The EZ Drill® packer and bridge plug and the EZ Drill® SV packer are designed for fast removal from the wellbore by either rotary or cable tool drilling methods. Many of the components in these drillable packing devices are locked together to prevent their spinning while being drilled, and the harder slips are grooved so that they will be broken up in small pieces. Typically, standard "tri-cone" rotary drill bits are used which are rotated at speeds of about 75 to about 120 rpm. A load of about 5,000 to about 7,000 pounds of weight is applied to the bit for initial drilling and increased as necessary to drill out the remainder of the packer or bridge plug, depending upon its size. Drill collars may be used as required for weight and bit stabilization.

Such drillable devices have worked well and provide improved operating performance at relatively high temperatures and pressures. The packers and bridge plugs mentioned above are designed to withstand pressures of about 10,000 psi (700 kg/cm$^2$) and temperatures of about 425° F. (220° C.) after being set in the wellbore. Such pressures and temperatures require using the cast iron components previously discussed.

However, drilling out cast iron components requires certain techniques. Ideally, the operator employs variations in rotary speed and bit weight to help break up the metal parts and re-establish bit penetration should bit penetration cease while drilling. A phenomenon known as "bit tracking" can occur, wherein the drill bit stays on one path and no longer cuts into the downhole tool. When this happens, it is necessary to pick up the bit above the drilling surface and rapidly recontact the bit with the packer or bridge plug and apply weight while continuing rotation. This aids in breaking up the established bit pattern and helps to re-establish bit penetration. If this procedure is used, there are rarely problems. However, operators may not apply these techniques or even recognize when bit tracking has occurred. The result is that drilling times are greatly increased because the bit merely wears against the surface of the downhole tool rather than cutting into it to break it up.

In order to overcome the above long-standing problems, the assignee of the present invention introduced to the industry a line of drillable packers and bridge plugs currently marketed by the assignee under the trademark FAS DRILL®. The FAS DRILL® line of tools has a majority of the components made of non-metallic engineering grade plastics to greatly improve the drillability of such downhole tools. The FAS DRILL® line of tools has been very successful and a number of U.S. patents have been issued to the assignee of the present invention, including U.S. Pat. No. 5,271,468 to Streich et al., U.S. Pat. No. 5,224,540 to Streich et al., and U.S. Pat. No. 5,390,737 to Jacobi et al, all of which are incorporated herein by reference.

Notwithstanding the success of the FAS DRILL® line of drillable downhole packers and bridge plugs, the assignee of the present invention discovered that certain metallic components still used within the FAS DRILL® line of packers and bridge plugs at the time of issuance of the above patents were preventing even quicker drill-out times under certain conditions or when using certain equipment. Exemplary situations include milling with conventional jointed tubulars and in conditions in which normal bit weight or bit speed could not be obtained. Other exemplary situations include drilling or milling with non-conventional drilling techniques such as milling or drilling with relatively flexible coiled tubing.

When milling or drilling with coiled tubing, which does not provide a significant amount of weight on the tool being used, even components made of relatively soft steel, or other metals considered to be low strength, create problems and increase the amount of time required to mill out or drill out a downhole tool, including such tools as the assignee's FAS DRILL® line of drillable non-metallic downhole tools.

Furthermore, packer shoes and optional back-up rings made of a metallic material are employed not so much as a first choice but due to the metallic shoes and back-up rings being able to withstand the temperatures and pressures typically encountered by a downhole tool deployed in a borehole.

To address the preceding shortcomings, the assignee hereof filed a U.S. patent application on May 5, 1995, Ser. No. 08/442,448, which issued on May 30, 1996, as U.S. Pat. No. 5,540,279 (the '279 patent), describing and claiming an improved downhole tool apparatus preferably utilizing essentially all non-metallic materials such as engineering grade plastics, resins, or composites. The '279 patent describes a wellbore packing-type apparatus making use of essentially only non-metallic components in the downhole tool apparatus for increasing the efficiency of alternative drilling and milling techniques in addition to conventional drilling and milling techniques and further provides a segmented non-metallic back-up ring in lieu of a conventional metallic packer shoe having a metallic supporting ring. The tool discussed in the '279 patent preferably employs the general geometric configuration of previously known drillable non-metallic packers and bridge plugs such as those disclosed in the aforementioned U.S. Pat. Nos. 5,271,468, 5,224,540, and 5,390,737, while replacing essentially all of the few remaining metal components of the tools disclosed in the aforementioned patents with non-metallic materials which can still withstand the pressures and temperatures found in many wellbore applications. In the '279 patent, the apparatus also includes specific design changes to accommodate the advantages of using essentially only plastic and composite materials and to allow for the reduced strengths thereof compared to metal components. Additionally, the '279 embodiment comprises a center mandrel and slip means disposed on the mandrel for grippingly engaging the wellbore when in a set position, a packing means disposed on the mandrel for sealingly engaging the wellbore when in a set position, the slip means comprising a slip wedge positioned around the center mandrel, a plurality of slip segments disposed in an initial position around the mandrel and adjacent to the slip wedge, and retaining means for holding the slip segments in an initial position. The slip segments expand radially outwardly upon being set so as to grippingly engage the wellbore. Hardened inserts can be molded, or otherwise installed into the slips, and can be made of, by way of example, a ceramic material.

In the preferred embodiment of the '279 patent, the slip means includes a slip wedge installed on the mandrel and the slip segments, whether retained by a retaining band or whether retained by an integral ring portion, have co-acting planar, or flat portions, which provided a superior sliding bearing surface especially when the slip means are made of a non-metallic material such as engineering-grade plastics, resins, phenolics, or composites.

Furthermore, in the '279 patent, prior art packer element shoes and back-up rings, such as those referred to as elements 37, 38, 44, and 45 in the U.S. Pat. No. 5,271,468, were replaced by a non-metallic packer shoe having a multitude of co-acting non-metallic segments and at least one retaining band, and preferably two non-metallic bands, for holding the shoe segments in place after initial assembly and during the running of the tool into the wellbore and prior to the setting of the associated packer element within the wellbore.

Notwithstanding the success of the invention described in the '279 patent, in that tools made in accordance thereto are able to withstand the stresses induced by relatively high differential pressures and high temperatures found within wellbore environments, the assignee of the present invention discovered that when using packer-type tools in high temperature environments, such as temperatures, for example, exceeding 250° F., there was a possibility for the non-metallic segmented packer element back-up shoes, also referred to as back-up rings, to allow the packer element to extrude through gaps that are designed to form between the back-up ring segments upon the segments being forced radially outward toward the wellbore surface when the packer element was activated. Upon certain conditions, the larger O.D. packer elements, and smaller O.D. packer elements upon being subjected to elevated pressures and temperatures, were subject to being extruded through these gaps thereby possibly damaging the packer element and jeopardizing the integrity of the seal between the wellbore and the packer elements.

To address the issue of unwanted extrusion, the assignee of the present invention filed a patent application on Mar. 29, 1996, which issued as U.S. Pat. No. 5,701,959 (the '959 patent) on Dec. 30, 1997, which is incorporated herein by reference. The '959 invention, like the '279 invention, includes a non-metallic shoe having a multitude of co-acting non-metallic segments and at least one retaining band, and preferably two retaining bands for holding the shoe segments in place after initial assembly and during the running of the tool into the wellbore and prior to the sealing of the associated packer element within the wellbore. The invention described in the '959 patent provides a disk to act as a gap-spanning, structural member. The shoe segments described in the '959 patent include disk pockets on an inner surface thereof. Each disk pocket is centered over the gap that it is to bridge, so that a pocket for a single disk comprises two half pockets located on adjacent shoe segments. The disk in the '959 patent was designed to span the gap between adjacent segments that increases in size when the packer element is set in the wellbore.

Although the inventions described in the '959 and '279 patents work well for their intended purpose, there is a further need for an easily drillable downhole packer-type tool apparatus preferably being made at least partly, if not essentially entirely, of nonmetallic, such as, but not limited to, composite components, and which include expandable packer elements to be partially retained by non-metallic segmented packer element shoes, or retaining rings that prohibit, or at least significantly reduce, unwanted extrusion of packer elements between gaps of such segmented shoes or segmented rings. While the invention described in the '279 patent works well in many cases, there is still a need for a retaining shoe that will prohibit, or at least limit, unwanted extrusion of the packer element in high pressure, high temperature wells of up to 350° F. and 10,000 psi.

SUMMARY OF THE INVENTION

The present invention provides a downhole packer apparatus for preventing the extrusion of a packer element assembly installed about a packer mandrel. The packer mandrel has a longitudinal central axis and a slip means disposed on the packer mandrel for grippingly engaging a wellbore, and preferably a casing in the wellbore, when the packer apparatus is moved from an unset to a set position. A packer element assembly is disposed about the packer mandrel and includes at least one packer element to be axially retained about the packer mandrel. The invention also includes at least one packer element assembly retaining shoe disposed about the packer mandrel for axially retaining the packer element assembly and for preventing extrusion of the packer element assembly when the packer apparatus is set into position. The retaining shoe includes an inner shoe and an outer shoe. The inner shoe is comprised of a plurality of inner shoe segments. Adjacent ones of the inner shoe segments have circumferential gaps therebetween which may be zero when initially installed but which will expand from the initial installed position, wherein the gaps may be zero or slightly greater than zero, to a greater width when the packer apparatus is set into position, thus moving the inner shoe to an expanded position. The inner shoe may comprise a generally cylindrical body portion which may engage the packer mandrel when the packer apparatus is in its unset position, and a fin sloping radially outwardly from the body portion. Each inner shoe segment thus comprises a body portion having a fin portion sloping radially outwardly therefrom.

The outer shoe of the retaining shoe is comprised of a plurality of outer shoe segments. Adjacent ones of the outer shoe segments will spread apart so that the width of a circumferential gap therebetween will expand as the retaining shoe moves from its initial position, wherein the outer shoe segments and the wellbore define a space therebetween, to an expanded position, wherein the retaining shoe engages the wellbore. The expanded position of the retaining shoe corresponds to the set position of the packer apparatus in the wellbore. In the expanded position of the retaining shoe, the retaining shoe engages the wellbore and prevents, or at least limits, extrusion of the packer element assembly. Wellbore is understood to mean either a wellbore in an open-hole completion or a casing disposed in a wellbore in a cased completion, unless the context indicates otherwise.

The present invention includes an inner wedge disposed about the packer mandrel. The inner wedge is preferably disposed in the inner shoe and will slide relative thereto when the retaining shoe moves from its initial position to its expanded position, corresponding to the movement of the packer apparatus from its unset position to its set position wherein the packer element assembly seals against the wellbore. When the retaining shoe moves to its expanded position, an annular gap is defined between the inner shoe and the packer mandrel. The inner wedge engages the end of the packer element assembly to prevent extrusion of the packer element assembly into the annular gap between the inner shoe and the packer mandrel.

BRIEF DESCRIPTION OF THE DRAWINGS

FIG. 8 is a cross-sectional view from line 8—8 of FIG. 7.

FIG. 9 is a cross-sectional view from line 9—9 of FIG. 7

FIG. 10 is a cross-sectional side view of a prior art packer element and retaining shoe.

DESCRIPTION OF PREFERRED EMBODIMENTS

Figure 1:
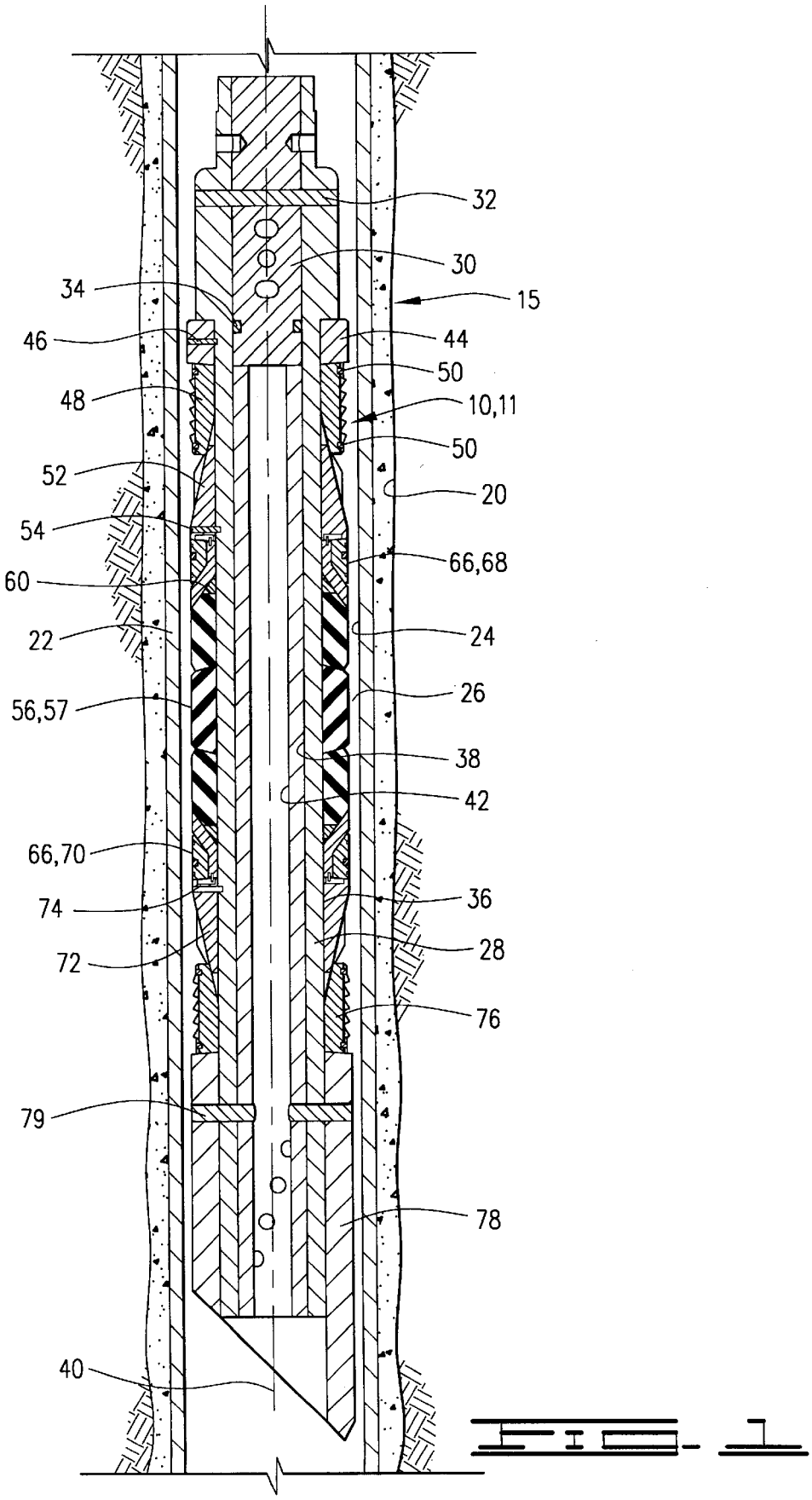
FIG. 1 is a cross-sectional side view of a packer apparatus having upper and lower retaining shoes embodying the present invention.
Figure 2:
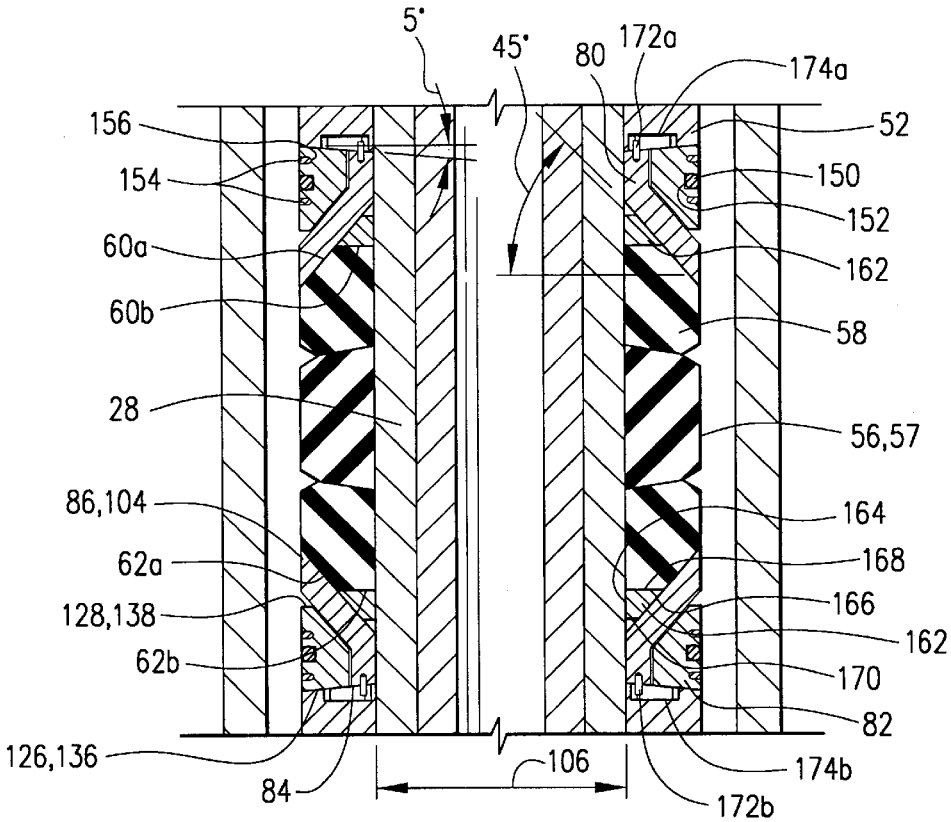
FIG. 2 is a cross-sectional side view of a packer element assembly and the retaining shoes of the present invention.
Figure 1:
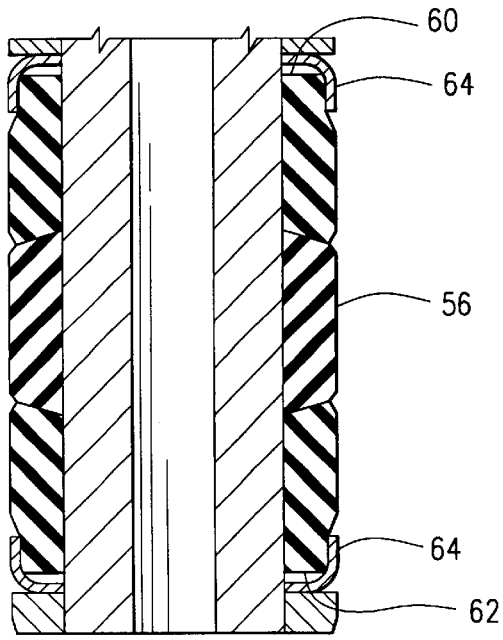
FIG. 1 PRIOR ART

Referring now to FIGS. 1 and 2, downhole tool, or downhole apparatus 10 is shown in an unset position 11 in a well 15 having a wellbore 20. The wellbore 20 can be either a cased completion with a casing 22 cemented therein as shown in FIG. 1 or an openhole completion. Downhole tool 10 may be referred to as packer apparatus 10. Packer apparatus 10 is shown in set position 13 in FIG. 3. Casing 22 has an inner surface 24. An annulus 26 is defined by casing 22 and packer apparatus 10. Packer apparatus 10 has a packer mandrel 28, and may be referred to as a bridge plug due to the packer apparatus 10 having a plug 30 being pinned within packer mandrel 28 by radially oriented pins 32. Plug 30 has a seal means 34 located between plug 30 and the internal diameter of packer mandrel 28 to prevent fluid flow therebetween. The overall downhole tool 10 structure, however, is adaptable to tools referred to as packers, which typically have at least one means for allowing fluid communication through the tool. Packers may therefore allow for the controlling of fluid passage through the tool by way of one or more valve mechanisms which may be integral to the packer body or which may be externally attached to the packer body. Such valve mechanisms are not shown in the drawings of the present document. Packer tools may be deployed in wellbores having casings or other such annular structure or geometry in which the tool may be set.

Packer mandrel 28 has an outer surface 36, an inner surface 38, and a longitudinal central axis, or axial centerline 40. An inner tube 42 is disposed in, and is pinned to packer mandrel 28 to help support plug 30.

Packer apparatus 10 includes the usage of a spacer ring 44 which is preferably secured to packer mandrel 28 by pins 46. Spacer ring 44 provides an abutment which serves to axially retain slip segments 48, which may be referred to as upper slip segments 48, which are positioned circumferentially about packer mandrel 28. Slip retaining bands 50 serve to radially retain upper slip segments 48 in an initial circumferential position about packer mandrel 28 as well as slip wedge 52, which may be referred to as upper slip wedge 52. Bands 50 are made of a steel wire, a plastic material, or a composite material having the requisite characteristics of having sufficient strength to hold the upper slip segments 48 in place prior to actually setting the downhole tool 10 and to be easily drillable when the downhole tool 10 is to be removed from the wellbore 20. Preferably, bands 50 are inexpensive and easily installed about upper slip segments 48. Upper slip wedge 52 is initially positioned in a slidable relationship to, and partially underneath, upper slip segments 48 as shown in FIG. 1. Upper slip wedge 52 is shown pinned into place by pins 54. The preferred designs of upper slip segments 48 and co-acting upper slip wedges 52 are described in U.S. Pat. No. 5,540,279, which is incorporated herein by reference.

Located below upper slip wedge 52 is a packer element assembly 56, which includes at least one packer element, and as shown in FIG. 1 includes three expandable packer elements 58 positioned about packer mandrel 28. Packer element assembly 56 has unset and set positions 57 and 59 corresponding to the unset and set positions 11 and 13, respectively, of packer apparatus 10. Packer element assembly 56 has upper end 60 and lower end 62. Upper and lower ends 60 and 62 may comprise sloped portions 60*a* and 62*a*, respectively, and generally flat portions 60*b* and 62*b*, respectively.

FIG. 10 shows a prior art arrangement wherein a single metallic shoe, such as shoe 64, is disposed about the upper and lower ends 60 and 62, respectively, of the packer element assembly 56.

Figure 3:
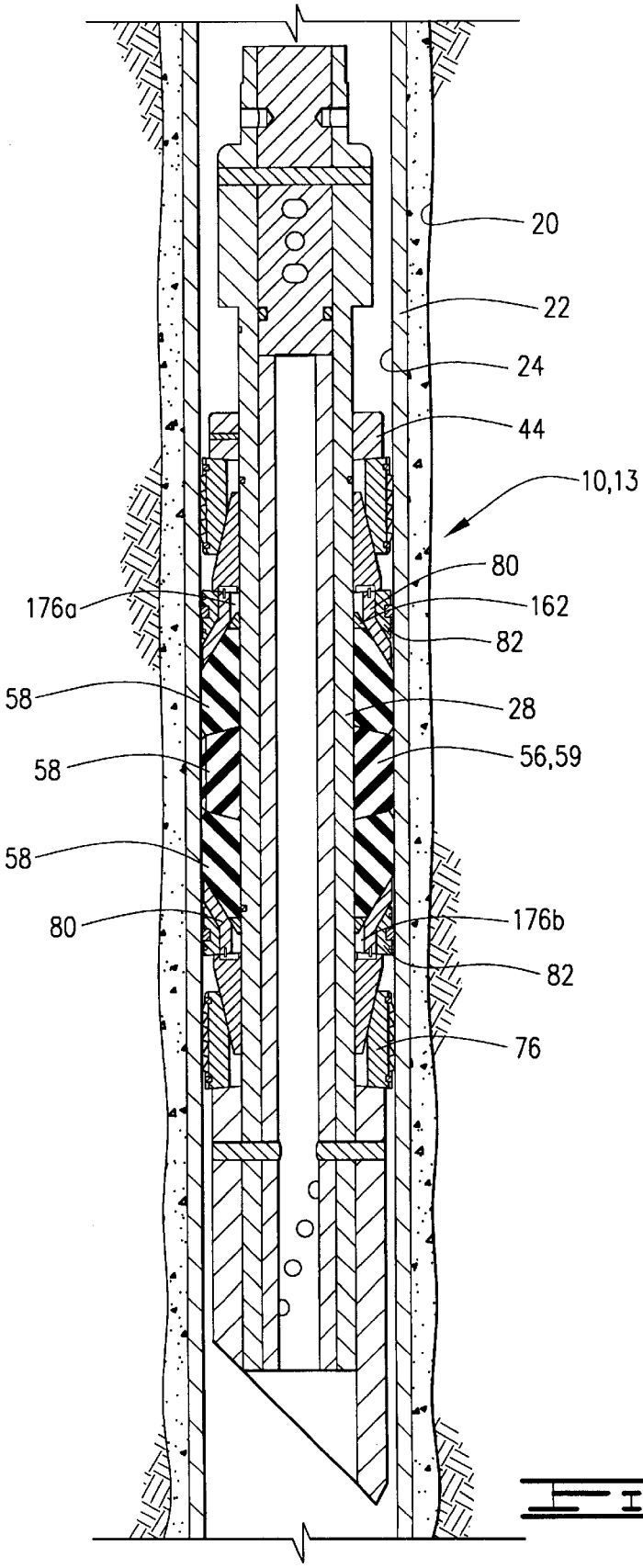
FIG. 3 is a cross-sectional side view of the packer apparatus of the present invention in a set position.

Referring to FIGS. 1–3, the present invention has retaining rings 66 disposed at the upper and lower ends 60 and 62 of packer element assembly 56 to axially retain the packer element assembly 56. Retaining rings, or retaining shoes 66 have first ends 67, and may be referred to as an upper retaining shoe, or upper retaining ring 68 and a lower retaining shoe, or lower retaining ring 70. A slip wedge 72, which may be referred to as lower slip wedge 72, is disposed about mandrel 28 below lower retaining shoe 70 and is pinned with a pin 74. Located below lower slip wedge 72 are lower slip segments 76. Lower slip wedge 72 and lower slip segments 76 are like upper slip wedge 52 and upper slip segments 48. At the lowermost portion of packer apparatus 10 is an angled portion, referred to as mule shoe 78, secured to mandrel 28 by pin 79. The lowermost portion of packer apparatus 10 need not be mule shoe 78 but can be any type of section which will serve to terminate the structure of the packer apparatus 10 or serve to connect the packer apparatus 10 with other tools, a valve or tubing, etc. It will be appreciated by those in the art that pins 32, 46, 54, 74, and 79, if used at all, are preselected to have shear strengths that allow for the packer apparatus 10 to be set and deployed and to withstand the forces expected to be encountered in the wellbore 20 during the operation of the downhole tool 10.

Referring now to FIGS. 2 and 4–9, the retaining shoes 66 of the present invention will be described. Upper and lower retaining shoes 68 and 70 are essentially identical. Therefore, the same designating numerals will be used to identify features on each of upper and lower retaining shoes 68 and 70, which are referred to collectively herein as retaining shoes 66. It will be understood that the features on upper retaining shoe 68 may be modified by the term upper, and the features on lower retaining shoe 70 may be modified by the term lower. Retaining shoes 66 comprise an inner shoe, or inner retainer 80 and an outer shoe, or outer retainer 82. Inner and outer shoes 80 and 82 may also be referred to as first and second shoes or retainers 80 and 82. Outer shoe 82 is preferably made of a phenolic material available from General Plastics & Rubber Company, Inc., 5727 Ledbetter, Houston, Tex. 77087-4095, which includes a direction-specific laminate material referred to as GP-B35F6E21K. Alternatively, structural phenolics available from commercial suppliers may be used. Inner shoes 80 are preferably made of a composite material available from General Plastics & Rubber Company, Inc., 5727 Ledbetter, Houston, Tex. 77087-4095. A particularly suitable material for the inner shoe 80 includes a direction specific composite material referred to as GP-L45425E7K available from General Plastics & Rubber Company, Inc. Alternatively, structural phenolics available from commercial suppliers may be used.

Inner shoe 80 has a first end 84, a second end 86, a first, or body portion 88, and a second, or fin portion 90 extending radially outwardly therefrom. First portion 88 has a first end 92 and a second end 94. Second portion 90 extends, or slopes, radially outwardly from second end 94 of first portion 88. Inner shoe 80 has an inner surface 96. Inner surface 96 may comprise inner surface 98 of first portion 88 and inner surface 100 of second portion 90. Inner surface 98 may define a generally cylindrical surface in the unset position 11 of packer apparatus 10.

As shown in FIG. 2, upper and lower ends 60 and 62 of packer element assembly 56 reside directly against upper and lower retaining shoes 68 and 70. Preferably, second portion 90 of inner shoe 80 engages sloped portions 60*a* and 62*a* at the upper and lower ends 60 and 62 of packer element assembly 56. Inner surface 100 is shaped to accommodate the upper and lower ends 60 and 62 of the packer element assembly 56, and preferably the sloped portions 60*a* and 62*a* thereof.

Second portion 90 has a first end 102 and a second end 104. Inner surface 100 of second portion 90 is thus preferably sloped as well as arcuate to provide a generally truncated conical surface which transitions from having a greater radius proximate the second end 104 of second portion 90 to a smaller radius at an internal diameter 106 which is defined by first portion 88. Inner surface 98 may engage packer mandrel 28 in the unset position 11 of packer apparatus 10.

Inner shoe 80 comprises a plurality of inner shoe segments 108. Each inner shoe segment 108 has sides 110 and 112 which are flat and convergent with respect to a center reference point which, if the inner shoe segments 108 are installed about the packer mandrel 28, will correspond to the longitudinal central axis 40 of the packer mandrel 28 as depicted in FIG. 1. Sides 110 and 112 need not be flat and can be of other topology.

Each inner shoe segment 108 has a body, or first portion 114 and a fin, or second portion 116. First and second portions 114 and 116 collectively comprise first portion 88 and second portion 90, respectively, of inner shoe 80.

Figure 4:
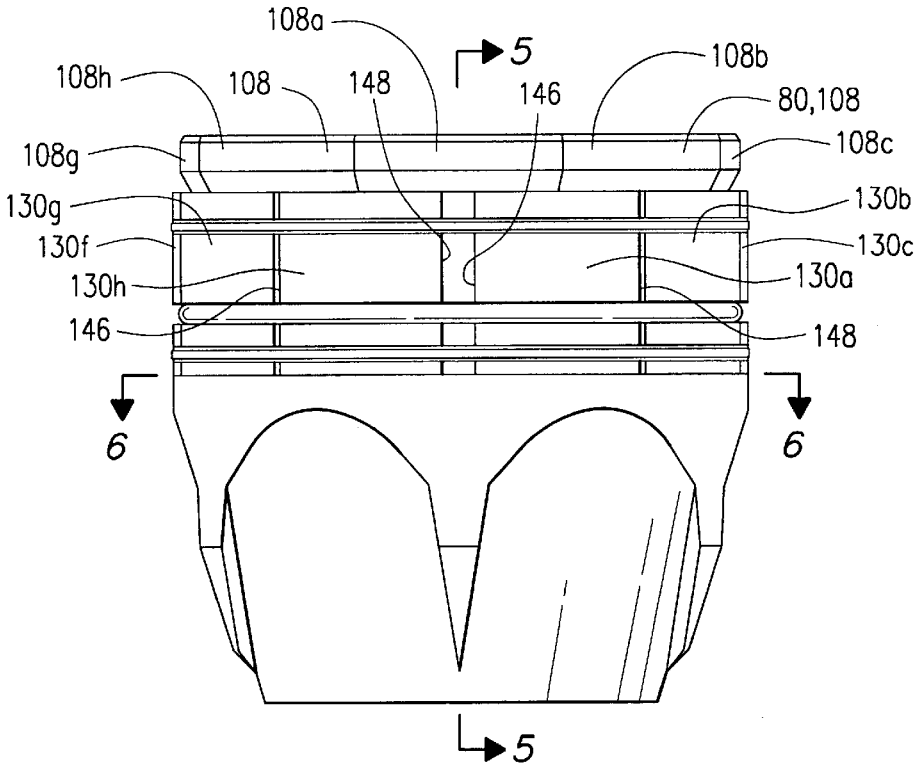
FIG. 4 is a side view of a retaining shoe of the present invention.
Figure 5:
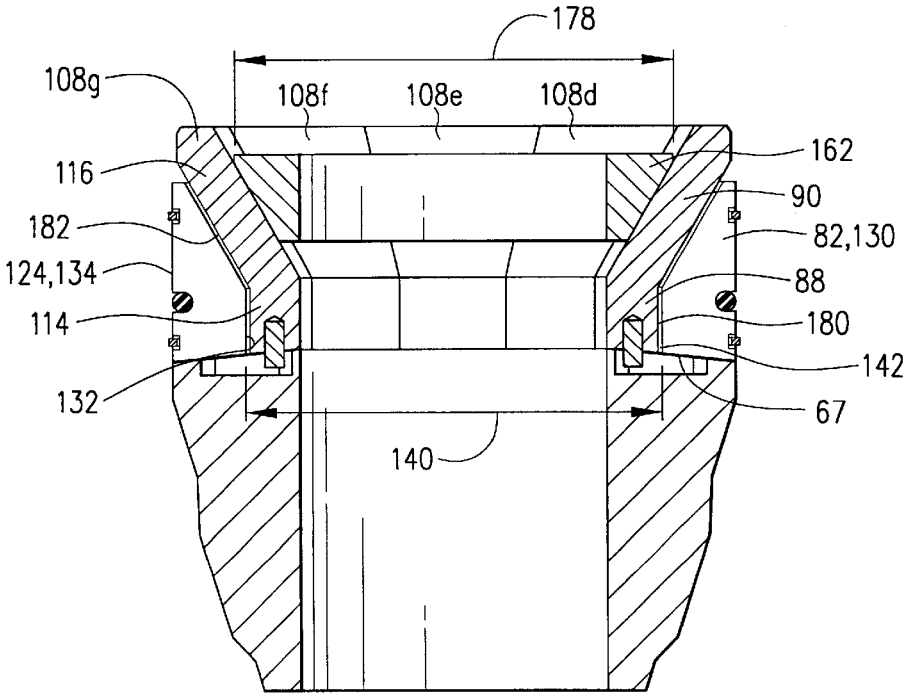
FIG. 5 is a cross-sectional view from line 5—5 of FIG. 4.

FIG. 4 illustrates inner shoe 80 being made of a total of eight inner shoe segments 108 to provide a 360° encircling structure to provide a maximum amount of end support for packer elements 58 to be retained in the axial direction. Inner shoe segments 108 are identified as inner shoe segments 108*a*–108*h* for ease of reference. A lesser or greater amount of inner shoe segments 108 can be used depending on the nominal diameters of the packer mandrel 28, the packer elements 58, and the wellbore 20 or casing 22 in which the downhole tool 10 is to be deployed. Inner diameter 106 generally approaches the inner diameter of the packer element assembly 56. The slope of inner surface 100 is preferably approximately 45° as shown in FIG. 2, but the exact slope will be determined by the exterior configuration of the ends of the packer elements 58 that are to be positioned and eventually placed in contact with retaining shoes 66. First end 84 of inner shoe 80 is slightly sloped, approximately 5° if desired, but it is also best determined by the surface of the downhole tool 10 which it eventually abuts against when packer apparatus 10 is centered in the wellbore 20.

A circumferential gap 118 is defined by adjacent sides 110 and 112 of inner shoe segments 108. Circumferential gap 118 has a width 120 which can be essentially zero when inner shoe segments 108 are initially installed about packer mandrel 28, and before packer apparatus 10 is moved from the unset position 11 to the set position 13. However, a small gap, for example a gap of 0.06" may be provided for on initial installation. Width 120 of circumferential gap 118, as will be described in more detail hereinbelow, will increase from that which exists on initial installation when packer apparatus 10 is moved from its unset position 11 to set position 13, thus moving retaining shoes 66 from an initial to an expanded position.

Referring now to FIGS. 4, 5, 7, and 8, outer shoe 82 has an inner surface 122, an outer surface 124, and first and second ends 126 and 128. Outer shoe 82 preferably has a plurality of individual outer shoe segments 130 which form outer shoe 82 which encircles inner shoe 80 and thus encircles packer mandrel 28. Outer shoe segments 130 have an inner surface 132, an outer surface 134, and have first and second ends 136 and 138. Inner surface 122 of outer shoe 82 defines an inner diameter 140 and thus defines a generally cylindrical surface 142 adapted to engage an outer surface 180 of first portion 88 of inner shoe 80. Inner surface 122 likewise defines a truncated conical surface 144 to accommodate an outer surface 182 of second portion 90 of inner shoe 80, and thus transitions from a greater radius proximate second end 128 to the inner diameter 140. Sides 146 and 148 of outer shoe segments 130 are flat and convergent with respect to a center reference point, which if the outer shoe segments 130 are installed about the packer mandrel 28, corresponds to the longitudinal central axis 40 of packer mandrel 28. Sides 146 and 148 need not be flat and can be of other topology.

Outer shoe 82 is illustrated as being made of a total of eight outer shoe segments 130 to provide a 360° encircling structure to provide the maximum amount of end support. Outer shoe segments 130 are identified as outer shoe segments 130*a*–130*h* for ease of reference. A lesser or greater amount of outer shoe segments 130 can be used depending upon the nominal diameters of the packer mandrel 28, the packer elements 58, and the wellbore 20 or casing 22 in which the downhole tool 10 is to be deployed. First end 126 of outer shoe 82 is slightly sloped, approximately 5°, if desired, but is best determined by the surface of the downhole tool 10 which the outer shoe 82 will eventually abut against, as for example in this case, upper and lower slip wedges 52 and 72.

An O-ring 150 is received in a groove 152 in outer shoe 82. Retaining bands 154 are received in grooves 156 to initially hold the outer shoe segments 130 in place prior to setting the packer apparatus 10. Adjacent sides 146 and 148 of outer shoe segments 130 define a circumferential gap 158 therebetween. Circumferential gap 158 between adjacent outer shoe segments 130 has a width 160 that can be essentially zero when outer shoe segments 130 are initially installed about packer apparatus 10, but a small gap, such as for example 0.06" may exist after initial installation. Width 160 will increase when packer apparatus 10 is moved to set position 13, thus moving retaining shoes 66 to their expanded position. Retaining bands 154 are preferably made of a non-metallic material, such as composite materials available from General Plastics & Rubber Company, Inc., 5727 Ledbetter, Houston, Tex. 77087-4095. However, retaining bands 154 may be alternatively made of a metallic material such as ANSI 1018 steel or any other material having sufficient strength to support and retain the retaining shoes 66 in position prior to actually setting the downhole tool 10. Furthermore, retaining bands 154 may have either elastic or non-elastic qualities depending on how much radial, and to some extent axial, movement of the outer shoe segments 130 can be tolerated prior to enduring the deployment of the associated downhole tool 10 into the wellbore 20.

Retaining shoes 66 further include an inner wedge, or shoe wedge 162. Shoe wedge 162 is preferably comprised of a drillable material, and is more preferably made from a composite material. Shoe wedge 162 may be made from the same material utilized for inner shoe 80. Shoe wedge 162 is disposed about packer mandrel 28 and has a generally cylindrical inner surface 164. Outer surface 166 of shoe wedge 162 is sloped so that the shoe wedge 162 defines a generally truncated cone shape. Shoe wedge 162 is disposed in inner shoe 80. The shoe wedge 162 of upper retaining shoe 68 will engage the upper end 60 of packer element assembly 56 while the shoe wedge 162 of lower retaining shoe 70 will engage lower end 62 of packer element assembly 56. Shoe wedge 162 has a first end 168 for engaging upper and lower ends 60 and 62 of packer element assembly 56 and a second end 170. Preferably, shoe wedges 162 engage flat portions 60*b* and 62*b*.

Referring now to FIGS. 1 and 2, packer apparatus 10 is shown in its unset position 11 and thus the packer element assembly 56 is in its unset position 57. FIG. 3 shows the set position 13 of packer apparatus 10 and the corresponding set position 59 of the packer element assembly 56.

In unset position 11, retaining bands 154 serve to hold outer shoe segments 130 in place, and thus also hold inner shoe segments 108 in place. Prior to packer apparatus 10 being set, inner shoe 80 and shoe wedge 162 engage packer mandrel 28 about the upper and lower ends 60 and 62 of packer element assembly 56. Inner shoe 80 and shoe wedge 162 of lower retaining shoe 70 engage lower end 62 of packer element assembly 56 and inner shoe 80 and shoe wedge 162 of upper retaining shoe 68 engage upper end 60 of packer element assembly 56 in the unset position 11 of packer apparatus 10. When packer apparatus 10 has reached the desired location in the wellbore 20, setting tools as are commonly known in the art will move packer apparatus 10 and the packer element assembly 56 to their set positions 13 and 59, respectively, as shown in FIG. 3, which will cause upper and lower retaining shoes 68 and 70 to move from the initial, installed position to the expanded position to limit extrusion of the packer element assembly 56.

As shown in FIGS. 4–9, inner shoe segments 108 are positioned so that circumferential gaps 118 will be located between the sides 146 and 148 of outer shoe segments 130. Likewise, circumferential gaps 158 between adjacent outer shoe segments 130 will be positioned between the sides 110 and 112 of inner shoe segments 108. Circumferential gaps 118 are thus offset angularly from circumferential gaps 158. Circumferential gaps 158 are thus spanned, or covered by inner shoe segments 108, and circumferential gaps 118 are thus spanned, or covered by outer shoe segments 130. When the packer apparatus 10 is moved to its set position 13, retaining bands 154 will break and retaining shoes 66, namely both of upper and lower retaining shoes 68 and 70, will move radially outwardly to engage inner surface 24 of casing 22. The radial movement will cause width 120 and width 160 of circumferential gaps 118 and 158, respectively, to increase. However, circumferential gaps 118 and 158 will still be angularly offset, and thus outer shoe segments 130 will span circumferential gaps 118, and inner shoe segments 108 will span circumferential gaps 158 when packer apparatus 10 is in either of its unset or set positions 11 and 13.

In one embodiment, each inner shoe segment 108 is affixed to an outer shoe segment 130, by gluing or other means known in the art. For example, in the embodiment shown, inner shoe segments 108*a*–108*h* are affixed by gluing or other means to outer shoe segments 130*a*–130*h*, respectively. Thus when inner and outer shoes 80 and 82 expand, inner shoe segment 108*a* will move with outer shoe segment 130*a*. Likewise, inner shoe segments 108*b*–108*h* will move with outer shoe segments 130*b*–130*h*, respectively. The attached shoe segments, for example shoe segments 108*a* and 130*a*, may be referred to as a segment pair.

O-ring 150 will exert a force radially inwardly on outer shoe 82, and will transfer the force to inner shoe 80 as packer apparatus 10 is moved from its unset position 11 to its set position 13. The inward force, along with the friction between inner shoe segments 108 and outer shoe segments 130, provides for a generally equal separation between inner shoe segments 108 and outer shoe segments 130. In other words, the width 120 of circumferential gaps 118 and the width 160 of circumferential gaps 158 will be essentially uniform, or will vary only slightly as the retaining shoes 66 move radially outwardly.

Figure 6:
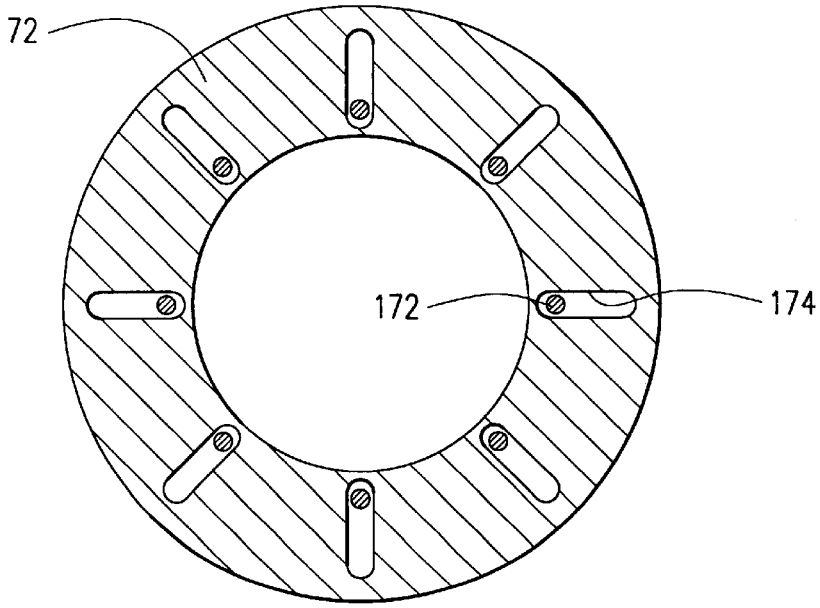
FIG. 6 is a cross-sectional view from line 6—6 of FIG. 4.
Figure 7:
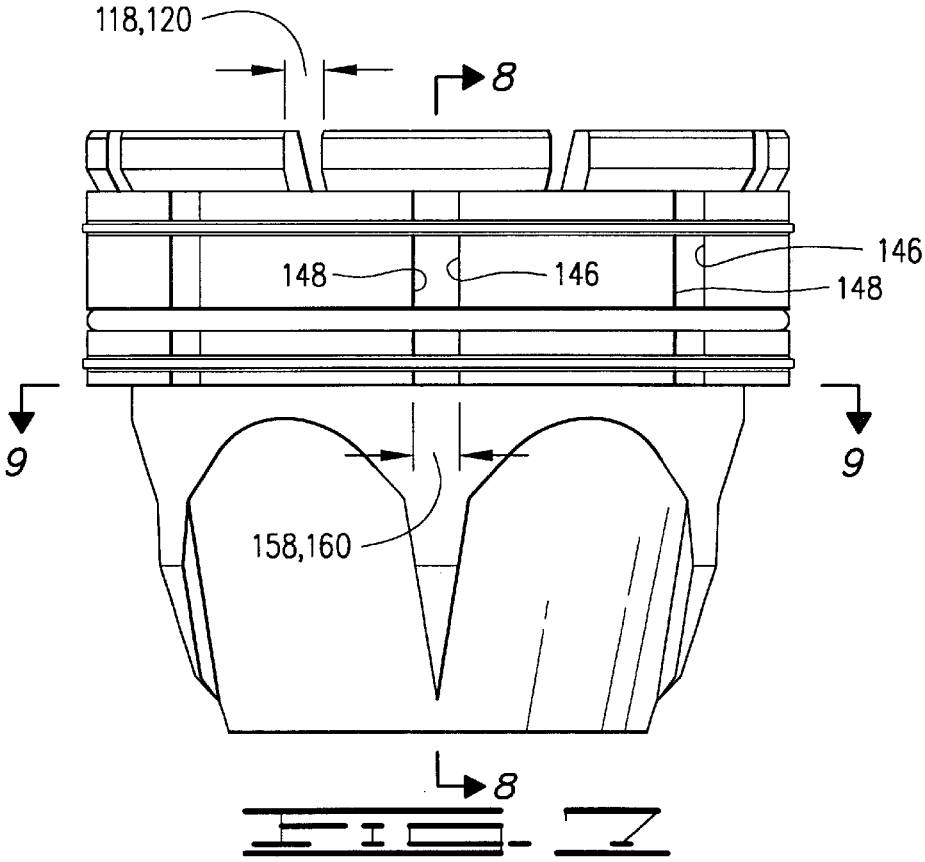
FIG. 7 is a side view of the retaining shoe of the present invention in an expanded position.
Figure 5:
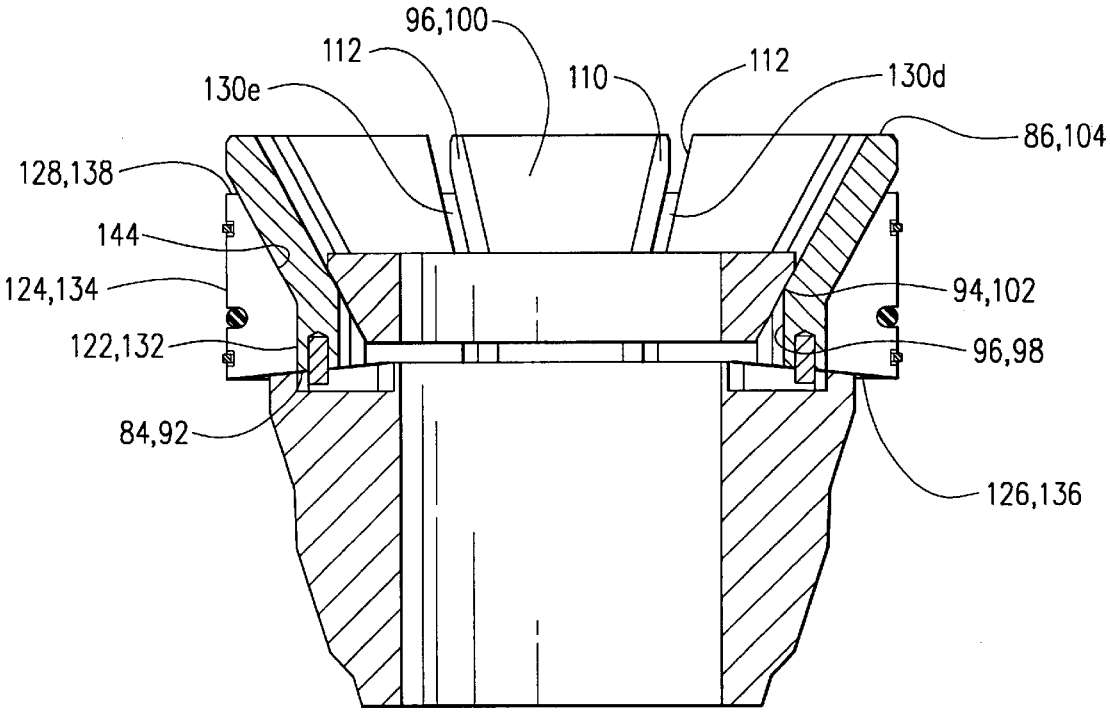
Figure 6:
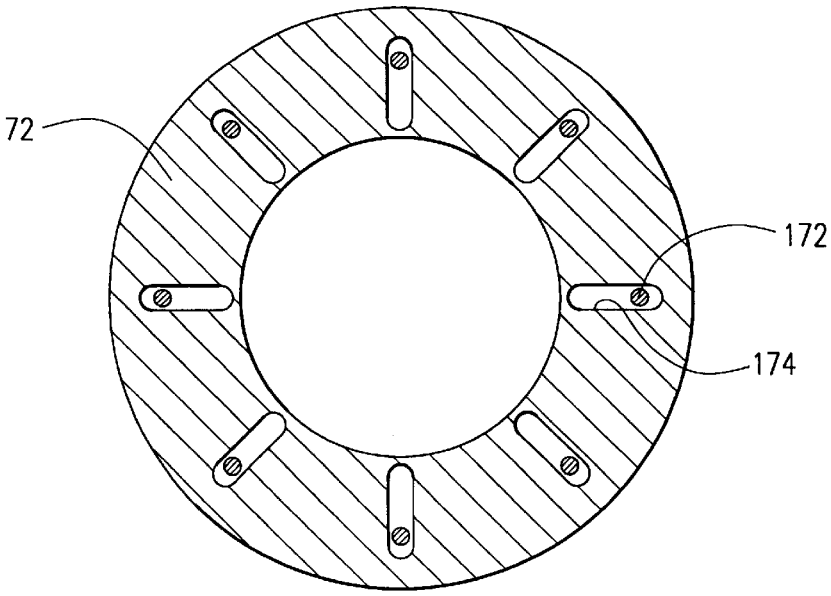

Retaining shoes 66 may also include a plurality of guide pins 172 connected to, and extending from, the first portion 88 of inner shoe 80. At least a portion of the inner shoe segments 108, and preferably, each of inner shoe segments 108, will have a guide pin 172 extending therefrom. In the drawings, guide pins 172 will be referred to as upper guide pins 172*a* and lower guide pins 172*b* for ease of reference. Upper and lower slip wedges 52 and 72 have guide slots 174 defined therein. Guide slots 174 may be referred to as upper guide slots 174*a* in upper slip wedge 52 and lower guide slots 174*b* in lower slip wedge 72. Guide slots 174 are defined in the ends of upper and lower slip wedges 52 and 72 that are adjacent upper and lower retaining shoes 68 and 70, respectively. Guide pins 172 are received in guide slots 174 and will move therein. FIG. 6 shows the position of guide pins 172 in guide slots 174 in the unset position 11 of packer apparatus 10 and FIG. 9 shows the position of guide pins 172 as they have moved radially outwardly when packer apparatus 10 is moved to its set position 13. Because guide pins 172 are captively held by and move in slots 174, the width 120 of circumferential gaps 118 will stay substantially equal when packer apparatus 10 moves from its unset position 11 to its set position 13. In other words, guide slots 174 will cause inner shoe segments 108 to maintain uniform circumferential gaps 118 therebetween as they move outwardly and the width 120 of circumferential gaps 118 expands. Because each of inner shoe segments 108 is glued, or otherwise affixed to an outer shoe segment 130, widths 160 of circumferential gaps 158 will likewise be substantially uniform. Because upper and lower retaining shoes 68 and 70 abut upper and lower slip wedges 52 and 72, such components may be referred to as abutment components 52 and 72 and guide slots 174 may be defined in whatever structure abuts the first ends 67 of upper and lower retaining shoes 68 and 70.

Although in the embodiment shown, guide pins 172 are connected to inner shoe segments 108, guide pins may be affixed or attached to outer shoe segments 130 in those cases where the size of the upper and lower slip wedges 52 and 72 is sufficient to allow the outer shoe segments 130 to travel radially outwardly to engage and seal casing 22. If desired, both of inner and outer shoe segments 108 and 130 may have guide pins 172, and corresponding guide slots 174 may be included for the guide pins 172. Guide pins 172 may be affixed to inner shoe segments 108, or may be machined as an integral part thereof. Preferably, the guide pins 172 are inserted in openings in inner shoe segments 108 and affixed with glue, or other means. Likewise, if guide pins are utilized in outer shoe segments 130, such guide pins may be affixed thereto, or machined as part of the outer shoe segments 130.

When packer apparatus 10 is moved to its set position 13, outer surface 124 of outer shoe 82 will engage inner surface 24 of casing 22. The extrusion of expandable packer elements 58 is essentially eliminated, since any material extruded through circumferential gaps 118 will engage outer shoe segments 130 which will prevent further extrusion. Upper and lower slip wedges 52 and 72 also provide a seal so that extrusion of the packer element assembly 56 is prevented.

When packer apparatus 10 is moved to its set position 13, an annular gap is defined between the first portions 88 of inner shoes 80 of upper and lower retaining shoes 68 and 70 respectively, and packer mandrel 28. The upper annular gap will be referred to as annular gap 176*a* and the lower annular gap will be referred to as annular gap 176*b*. Extrusion of packer element assembly 56 into annular gaps 176*a* and 176*b* is prevented by inner wedge 162 which engages the upper and lower ends 60 and 62 of packer element assembly 56. Inner wedge 162 slides relative to inner shoe 80 when the packer apparatus 10 is moved from its unset position 11 to its set position 13. An outer diameter 178 of inner wedge 162 is greater than the inner diameter 106 of first portion 88 of inner shoe 80 when the packer apparatus 10 is in its set position 13 so that inner wedge 162 may not be received completely in first portion 88. Inner wedge 162 will thus prevent any extrusion into annular gaps 176*b* and 176*a*. Retaining shoes 66 are thus expandable retaining shoes and will prevent or at least limit the extrusion of the packer elements 58. Inner and outer shoes 80 and 82 may be referred to as radially expandable shoes. The arrangement is particularly useful in high pressure, high temperature wells, since there is no extrusion path available. It should be understood however, that the disclosed retaining shoes 66 may be used in connection with packer-type tools of lesser or greater diameters, differential pressure ratings, and operating temperature ratings than those set forth herein.

Shoe wedge 162 may be designed to shear so that when packer apparatus 10 is moved to its set position 13, a portion of shoe wedges 162 will be urged into annular gaps 176*a* and 176*b*. In other words, shoe wedges 162 may shear in a circular shear plane in which shoe wedges 162 contact second end 94 of first portion 88. In such a case, the sheared portion will fill at least a portion of annular gaps 176*a* and 176*b*, and extrusion is still prevented, so that packer element assembly 56 can seal properly against the well 15.

Although the disclosed invention has been shown and described in detail with respect to a preferred embodiment, it will be understood by those skilled in the art that various changes in the form and detailed area may be made without departing from the spirit and scope of this invention as claimed. While numerous changes may be made by those skilled in the art, such changes are encompassed within the spirit of this invention as defined by the appended claims.

What is claimed is:

1. A packer apparatus for use in a wellbore, the packer apparatus comprising:

a packer mandrel;

a packer element assembly disposed about the packer mandrel, wherein the packer element assembly has an upper end and a lower end;

an upper retaining shoe disposed about the packer mandrel above the upper end of the packer element assembly for axially retaining the packer element assembly; and a lower retaining shoe disposed about the packer mandrel below the lower end of the packer element assembly for axially retaining the packer element assembly;

wherein at least one of the upper retainer shoe and lower retaining shoe comprises:

an expandable inner shoe disposed about the packer mandrel;

an expandable outer shoe disposed about the inner shoe; and an inner wedge disposed about the packer mandrel and positioned in the inner shoe for engaging the corresponding one of the upper end or lower end of the packer element assembly.

2. The packer apparatus of claim 1, wherein the outer shoe comprises a plurality of outer shoe segments, and the inner shoe comprises a plurality of inner shoe segments.

3. The packer apparatus of claim 1, wherein both the upper retaining shoe and lower retaining shoe comprise:

the expandable inner shoe;

the expandable outer shoe; and the inner wedge;

wherein the inner wedge of the upper retaining shoe engages the upper end of the packer element assembly, and the inner wedge of the lower retaining shoe engages the lower end of the packer element assembly.

4. The packer apparatus of claim 3, wherein the packer apparatus is movable from an unset position to a set position in the wellbore, the inner shoes and outer shoes expand radially outwardly when the packer apparatus moves from the unset position to the set position, the outer shoes engage the wellbore in the set position, and the packer element assembly sealingly engages the wellbore in the set position.

5. The packer apparatus of claim 4, wherein the inner wedges slide relative to the packer mandrel when the packer apparatus moves from the unset position to the set position.

6. The packer apparatus of claim 4, wherein the inner shoes comprise:

a first portion defining a generally cylindrical inner surface in the unset position; and a second portion connected to, and sloping radially outwardly from, the first portion;

wherein the inner surface of the first portion and the packer mandrel define an annular space therebetween in the set position, and the corresponding inner wedge engages the packer element assembly and prevents the packer element assembly from filling the annular space.

7. The packer apparatus of claim 4, wherein the inner shoes comprise a plurality of inner shoe segments, each inner shoe segment comprising:

a first portion having a first end and a second end;

a second portion extending radially outwardly from the second end of the first portion; and a guide pin attached to, and extending from, the first end of the first portion of at least a portion of the inner shoe segments;

wherein the packer apparatus further comprises:

an upper slip wedge disposed about the packer mandrel; and a lower slip wedge disposed about the packer mandrel;

wherein the upper slip wedge and the lower slip wedge have ends adjacent the first end of the first portion of the inner shoe segments of the inner shoes, the upper slip wedge and lower slip wedge have a plurality of guide slots defined therein, the guide pins in the inner shoe segments of the upper retaining shoe are received in the guide slots in the upper slip wedge, the guide pins in the inner shoe segments of the lower retaining shoe are received in the guide slots in the lower slip wedge, and the guide pins move in the guide slots when the packer apparatus moves from the unset position to the set position.

8. A retaining shoe for limiting the extrusion of a packer element assembly disposed about a packer mandrel, wherein the packer element assembly is movable from an unset position to a set position in a wellbore, and the packer element assembly seals the wellbore when moved to the set position, the retaining shoe comprising:

an outer shoe comprising a plurality of outer shoe segments;

an inner shoe comprising a plurality of inner shoe segments; and an inner wedge disposed about the packer mandrel for engaging an end of the packer element assembly;

wherein the inner shoe segments and outer shoe segments move radially outwardly when the packer element assembly moves from the unset position to the set position, adjacent ones of the outer shoe segments have a gap therebetween, and adjacent ones of the inner shoe segments have a gap therebetween when the packer element assembly is in the set position.

9. The retaining shoe of claim 8, wherein the outer shoe segments span the gaps between the inner shoe segments, and the inner shoe segments span the gaps between the outer shoe segments.

10. The retaining shoe of claim 9, wherein the inner shoe and the packer mandrel define an annular space therebetween in the set position, and the inner wedge prevents the packer element assembly from filling the annular space.

11. The retaining shoe of claim 9, wherein the inner wedge is slidable relative to the inner shoe.

12. The retaining shoe of claim 9 wherein each inner shoe segment comprises:

a body portion having first end and a second end; and a fin portion connected to, and extending radially outwardly from, the second end of the body portion.

13. The retaining shoe of claim 12, wherein the body portions of the inner shoe segments define a generally cylindrical shape in the unset position of the packer element assembly.

14. The retaining shoe of claim 9, wherein the outer shoe segments sealingly engage the wellbore when the packer element assembly is moved to the set position.

15. The retaining shoe of claim 9, wherein the inner wedge defines a truncated cone.

16. The retaining shoe of claim 8 further comprising a guide pin extending from at least a portion of the inner shoe segments, wherein the guide pin is receivable and movable in a guide slot defined in a slip wedge disposed about the packer mandrel.

17. A packer apparatus for use in a wellbore, the packer apparatus comprising:

a packer mandrel;

a packer element assembly disposed about the packer mandrel, wherein the packer element assembly has an upper end and a lower end, is movable from an unset position wherein the packer element assembly and the wellbore define a gap therebetween, to a set position wherein the packer element assembly sealingly engages the wellbore;

an upper retaining shoe for axially retaining the packer element assembly, the upper retaining shoe comprising:

an expandable inner shoe disposed about the packer mandrel;

an expandable outer shoe disposed about the inner shoe; and an inner wedge slidably disposed in the inner shoe for engaging the upper end of the packer element assembly; and a lower retaining shoe for axially retaining the packer element assembly, the lower retaining shoe comprising:

an expandable inner shoe disposed about the packer mandrel;

an expandable outer shoe disposed about the inner shoe; and an inner wedge slidably disposed in the inner shoe for engaging the lower end of the packer element assembly.

18. The packer apparatus of claim 17, wherein an annular gap is defined between the inner shoes and the packer mandrel when the packer element assembly is in the set position, and the inner wedges prevent the packer element assembly from filling the annular gaps.

19. The packer apparatus of claim 17, wherein the inner shoes comprise a plurality of inner shoe segments, and adjacent ones of the inner shoe segments have gaps therebetween when the packer element assembly is in the set position.

20. The packer apparatus of claim 19, wherein the outer shoes comprise a plurality of outer shoe segments, and adjacent ones of the outer shoe segments have gaps therebetween when the packer element assembly is in the set position.

21. The packer apparatus of claim 20, wherein the outer shoe segments span the gaps between the inner shoe segments, and the inner shoe segments span the gaps between the outer shoe segments.

22. The packer apparatus of claim 19, further comprising means for equalizing the gaps between the adjacent ones of the inner shoe segments.

23. The packer apparatus of claim 22, further comprising:

an upper slip wedge disposed about the packer mandrel, wherein the upper slip wedge is positioned above the upper retaining shoe, and the upper slip wedge has a plurality of guide slots defined in an end thereof; and a lower slip wedge disposed about the packer mandrel, wherein the lower slip wedge is positioned below the lower retaining shoe, and the lower slip wedge has a plurality of guide slots defined in an end thereof;

wherein the means for equalizing comprises guide pins extending from the inner shoe segments, the guide pins are receivable in, and movable in, the guide slots in the upper slip wedge and lower slip wedge.

24. The apparatus of claim 19, further comprising:

guide pins extending from at least a portion of the inner shoe segments, wherein the guide pins are movably received in corresponding guide slots defined in an upper abutment component and lower abutment component disposed about the packer mandrel.

25. A retaining shoe for limiting the extrusion of a packer element assembly disposed about a packer mandrel, wherein the packer element assembly is movable from an unset position to a set position in a wellbore, and the packer element assembly seals the wellbore when moved to the set position, the retaining shoe comprising:

an outer shoe comprising a plurality of outer shoe segments; and an inner shoe comprising a plurality of inner shoe segments, wherein each of the inner shoe segments is affixed by gluing to an outer shoe segment to define a segment pair, and the segment pairs move radially outwardly so that the outer shoe segments engage the wellbore when the packer element assembly moves from its unset position to the set position, adjacent ones of the outer shoe segments having a gap therebetween, and adjacent ones of the inner shoe segments having a gap therebetween when the packer element assembly is in the set position, and wherein the outer shoe segments span the gaps between the inner shoe segments, and the inner shoe segments span the gaps between the outer shoe segments.

26. A retaining shoe for limiting the extrusion of a packer element assembly disposed about a packer mandrel, wherein the packer element assembly is movable from an unset position to a set position in a wellbore, and the packer element assembly seals the wellbore when moved to the set position, the retaining shoe comprising:

an outer shoe comprising a plurality of outer shoe segments;

an inner shoe comprising a plurality of inner shoe segments, wherein each of the inner shoe segments is affixed by gluing to an outer shoe segment to define a segment pair, and the segment pairs move radially outwardly so that the outer shoe segments engage the wellbore when the packer element assembly moves from its unset position to the set position, adjacent ones of the outer shoe segments having a gap therebetween, and adjacent ones of the inner shoe segments having a gap therebetween when the packer element assembly is in the set position; and a guide pin extending from at least a portion of the segment pairs, wherein the guide pins are received in guide slots defined in a component disposed about the packer mandrel and adjacent the retaining shoe.

27. The retaining shoe of claim 26, wherein the component disposed about the packer mandrel comprises a slip wedge.

28. The retaining shoe of claim 26, wherein the guide pins are attached to the inner shoe segments in the at least a portion of the segment pairs.

* * * * *